US006857850B2

(12) United States Patent
Poock

(10) Patent No.: US 6,857,850 B2
(45) Date of Patent: Feb. 22, 2005

(54) FAN FOR A GRAIN BIN AND THE LIKE

(75) Inventor: Randall M. Poock, Hampton, IA (US)

(73) Assignee: Sukup Manufacturing Company, Sheffield, IA (US)

( * ) Notice: Subject to any disclaimer, the term of this patent is extended or adjusted under 35 U.S.C. 154(b) by 0 days.

(21) Appl. No.: 10/435,826

(22) Filed: May 12, 2003

(65) Prior Publication Data

US 2004/0228727 A1 Nov. 18, 2004

(51) Int. Cl.[7] ..... F04D 29/52

(52) U.S. Cl. ..... 415/220; 416/63; 416/189
(58) Field of Search ..... 415/220, 221; 416/63, 189

(56) References Cited

U.S. PATENT DOCUMENTS 3,976,393 A * 8/1976 Larson ..... 415/119
4,558,523 A * 12/1985 Isbell et al. ..... 34/491
5,615,999 A * 4/1997 Sukup ..... 415/182.1
6,081,961 A * 7/2000 Wang ..... 15/327.2

* cited by examiner

*Primary Examiner*—Ninh H. Nguyen

(57) ABSTRACT

A fan for use with a grain structure and the like having end plates in spaced parallel alignment with an inlet port in one plate and an outlet port in the opposite plate, a barrel housing positioned between the end plates and in communication with the ports, and a plurality of reinforcing members secured to, and extending between, the end plates and being in spaced relation to an outside surface of the barrel housing to permit the manual grasping thereof for purposes of moving the fan.

7 Claims, 2 Drawing Sheets

FAN FOR A GRAIN BIN AND THE LIKE

BACKGROUND OF THE INVENTION

This invention is directed toward a fan for use with a structure for storing grain, and more specifically a fan having reinforcing members for ease of gripping.

Fans are well known in the art and are used for many purposes including aerating, cooling and drying in a structure by blowing air into the structure. The drying process can be accelerated by adding a heater to the fan. Conventional fans can be rather heavy, weighing up to 275 lbs., and because of their size can be difficult to move and position. To assist in the movement of the fans, some manufacturers have bolted handles to the outer surface of the barrel of the fan. Not only does this add to the difficulty and cost of manufacturing, but the handles provide limited gripping area for multiple individuals, and the position of the handles can interfere with heater pipe trains on heater housings and wire conduits that extend through the side of the fan housing. Also, conventional handles provide no additional structural support between the ends of the fan.

Therefore, a primary objective of the present invention is to provide a fan that is easier to move and install.

Another objective of the present invention is to provide a fan with greater structural integrity.

A still further objective of the invention is to provide a fan that is easier and more economical to manufacture.

Another objective of the present invention is to provide a greater flexibility in positioning the reinforcing member or handle.

Another objective of the present invention is to provide a fan with a substantially increased gripping area to accommodate multiple individuals.

These and other objectives will become apparent to those skilled in the art based on the following description.

BRIEF SUMMARY OF THE INVENTION

The grain drying fan has a first end plate, a second end plate and a barrel housing extending therebetween. The end plates can be substituted with an attached flange or angle rings. The first end plate has an inlet port in communication with the barrel housing at one end and the second end plate has an outlet port in communication with the barrel housing at the opposite end. Secured to the outer periphery of the end plates, and extending therebetween, are a plurality of reinforcing members that provide structural support to the outer edges of the end plates and provide greater gripping area for multiple individuals to move and install the fan.

DESCRIPTION OF THE PREFERRED EMBODIMENTS

The following description outlines the invention as it relates to grain structures. Grain structures include both grain bins and grain buildings. The invention can be used for other applications such as, by example, by fire departments for removing smoke from a building.

Figure 1:
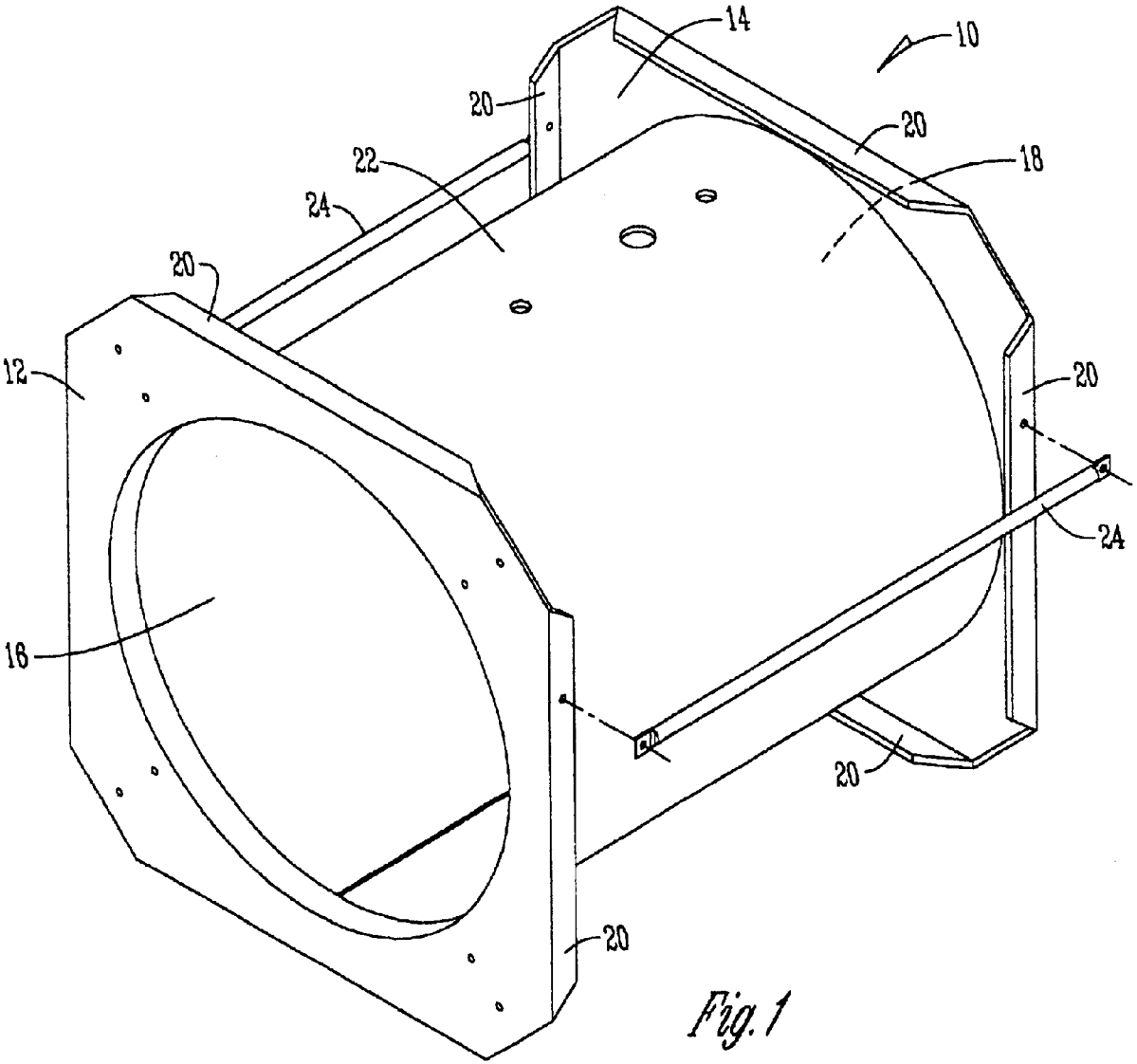
FIG. 1 is a perspective view of a fan.
Figure 2:
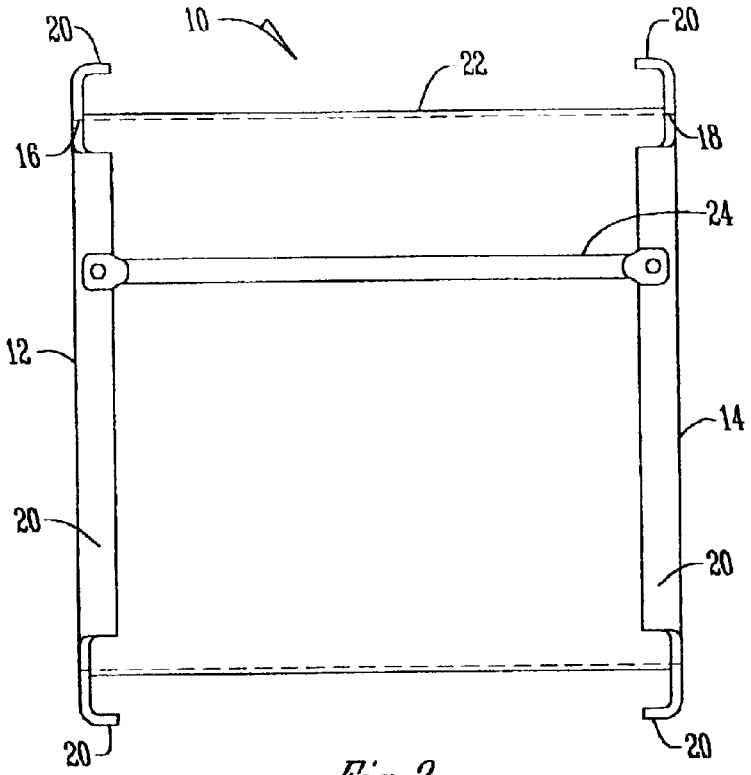
FIG. 2 is a side view of a fan.
Figure 3:
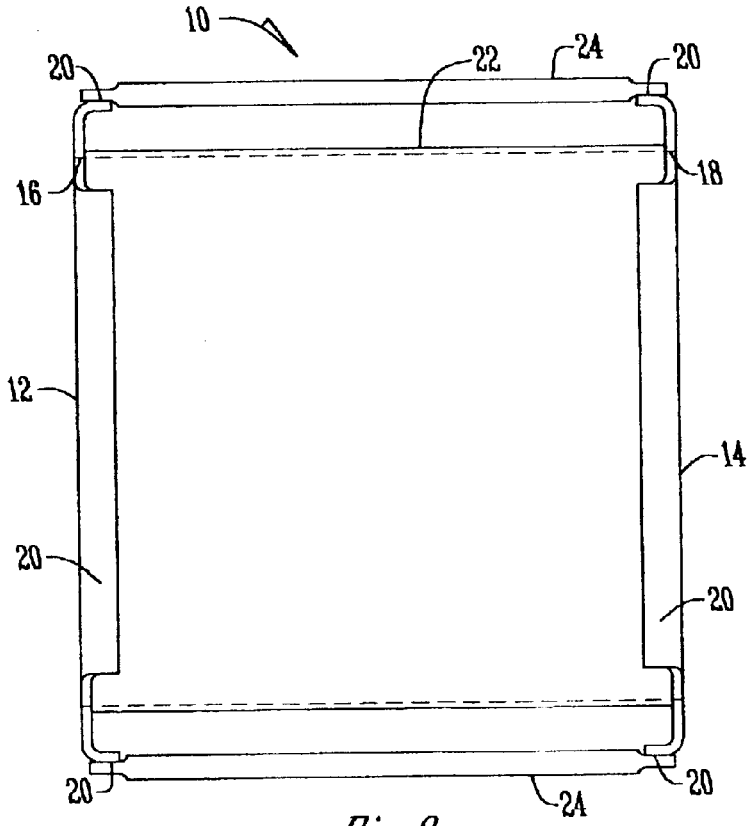
FIG. 3 is a top view of the fan.

Referring to FIGS. 1–3, the fan is referred to generally by reference numeral 10 and includes a first end extension such as a first end plate 12 and a second end extension such as a second end plate 14. The first end plate 12 has an inlet port 16 centrally located therein and the second end plate 14 has an outlet port 18 centrally located therein. The plates 12 and 14 are positioned in spaced parallel alignment such that port 16 and port 18 are likewise aligned. Extending inwardly from the outer periphery of both plate 12 and plate 14 are a plurality of flanges 20.

Secured between plate 12 and plate 14 and in communication with port 16 and port 18 is a barrel housing 22. The barrel 22 houses the fan assembly (not shown). While the use of end plates are preferred, the first and second end extensions can be replaced with angle rings formed at the ends of the barrel housing or flanges that are attached at the ends of the barrel housing.

As shown in FIG. 1, secured to each side, and extending between plate 12 and plate 14, are reinforcing members 24. Preferred are that the members are attached to the flanges 20 on either the inner or outer surface of the flanges. The members 24, in addition to maximizing the gripping area for installation and movement, provide structural support for the outer edges of plates 12 and 14. Providing a member extending between the plates substantially increases the gripping area allowing multiple individuals to grab hold and assist in moving and installing the fan which can weigh as much as 275 lbs. The members 24 can be attached to the top, the bottom, or any point inbetween on the sides of the plates 12 and 14. Not only is this means of attachment easy and cost effective, but it allows for greater flexibility in positioning the reinforcing members 24 so as not to interfere with pipe trains and electrical conduits that extend from the barrel housing 22. Conventional handles which are secured to the barrel housing are limited to generally the 3 o'clock and 9 o'clock position in relation to the top of the barrel housing. This provides little flexibility in avoiding pipe trans and wire conduits. In contrast, members 24 provide more latitude in the position of attachment including the entire vertical position along the end plates.

As can be seen from this disclosure, this invention meets the objectives of providing greater structural support, greater ease of movement, more flexibility in the position of the member, increased gripping area, and easier and more economical manufacturing.

What is claimed is:

1. A grain drying fan for aerating, ventilating, cooling, or drying comprising: a barrel housing having a first end extension and a second end extension;

an inlet port centrally located in the first end extension;

an outlet port centrally located in the second end extension; and a plurality of reinforcing rods secured to the first end extension and the second end extension and extending therebetween and being in spaced relation to an outside surface of the barrel housing to permit the manual grasping thereof for purposes of moving the fan.

2. The device of claim 1 wherein a plurality of flanges extend inwardly from the first end extension and the second end extension.

3. The device of claim 2 wherein the reinforcing rods are secured to the flanges.

4. The device of claim 1 wherein the first end extension and the second end extension are end plates secured to the barrel housing.

5. The device of claim 1 wherein the first end extension and the second end extension are angle rings integral to the barrel housing.

6. The device of claim 1 wherein the first end extension and the second end extension are flanges secured to the barrel housing.

7. The device of claim 1 wherein the reinforcing rods are secured to the outer peripheries of the first end extension and the second end extension.

* * * * *